United States Patent [19]

Humphrey

[11] Patent Number: 4,776,811

[45] Date of Patent: Oct. 11, 1988

[54] CONNECTOR GUIDE PIN

[75] Inventor: David T. Humphrey, Mechanicsburg, Pa.

[73] Assignee: E.I. Du Pont de Nemours and Company, Wilmington, Del.

[21] Appl. No.: 37,924

[22] Filed: Apr. 13, 1987

[51] Int. Cl.[4] ..... H01R 23/72

[52] U.S. Cl. ..... 439/378; 439/571

[58] Field of Search ..... 439/78–84, 439/544, 562–565, 552–558, 571–573, 378–381

[56] References Cited

U.S. PATENT DOCUMENTS 3,975,076 8/1976 Shida et al. ..... 439/62

4,363,530 12/1982 Verhoeven ..... 439/78

*Primary Examiner*—Neil Abrams

[57] ABSTRACT

There is described herein a compliant plastic guide pin for use with printed circuit board connectors. The guide pin has a tapered flange and a slot to permit the guide pin to be inserted through apertures in the connectors and circuit board to engage the printed circuit board between two connectors.

6 Claims, 3 Drawing Sheets

CONNECTOR GUIDE PIN

BACKGROUND OF THE INVENTION

This invention relates to a guide pin for electrical connectors.

With the extensive use of printed circuit boards as a mount for microchips and other circuit elements, it is becoming increasingly necessary to provide electrical connectors for joining the board's circuits together. Typically a plurality of daughter boards are connected perpendicularly to a master board, usually denoted as a mother board. With the larger number of circuit elements attached to a given board it is necessary often to make the connectors of longer and longer length to provide the additional pins required for the numerous electrical connections. As the length of the electrical connectors increases, it is necessary to locate one or more guide pins at the mid-portions of the connectors to overcome any slight warping that may occur in the connectors and to maintain the appropriate alignment between the connectors so that their respective pins may properly engage.

It is known to use stainless steel guide pins formed with screw machines. While these pins are quite satisfactory, they have several disadvantages. Among these are that their fabrication and installation is somewhat expensive and time consuming. Furthermore, it is not always desirable to form a guide pin of an electrically conductive material particularly where such material can cause inductive loading of the circuits in close proximity to the guide pin. The installation is not only time consuming but is also difficult since access must be had to both sides of the board. Because of the close spacing of the boards, this not always possible.

SUMMARY OF THE INVENTION

Many of the disadvantages of the prior art guide pins are overcome by the subject invention in which a double ended guide pin is adapted to secure and position header and shroud connectors on opposite sides of a printed circuit board, the guide pin being positioned in one encounter and adapted to engage apertures similarly located in the other connector and the circuit board, the guide pin comprising:

an integral elongated pin having a longitudinal axis, tapered ends, a first flange located thereon between the mid-portion of the pin and one end, and a second flange located thereon between the mid-portion of the pin and the other end, the second flange being tapered on one side toward the other end of the pins, the pin being slotted along the longitudinal axis in the region of the second flange, thereby to facilitate its insertion through the apertures in the connectors and circuit board.

Preferably the guide pins are formed of plastic material. Suitable plastics are those which provide a relatively high tensile strength and high ductility. These include polyetherimide, polyester, and nylon. The flanges on the guide pins typically are separated along the pin axis by a distance corresponding to the axial length of the connector apertures and the circuit board thickness such that when the guide pin is snapped into place, the connectors are securely gripped by the two flanges of the guide pin to attach the circuit board between the connectors. The guide pins thus formed are relatively easy to construct since they may be molded by conventional techniques. They are not magnetic and being also a nonconductor of electricity do not provide any possibility of creating electrical short circuits. Finally they may be inserted from one side of the circuit board, access to both sides not being required.

BRIEF DESCRIPTION OF THE DRAWINGS

The invention may be better understood when considered in conjunction with the accompanying drawings in which.

DETAILED DESCRIPTION OF THE PREFERRED EMBODIMENT

Figure 1:
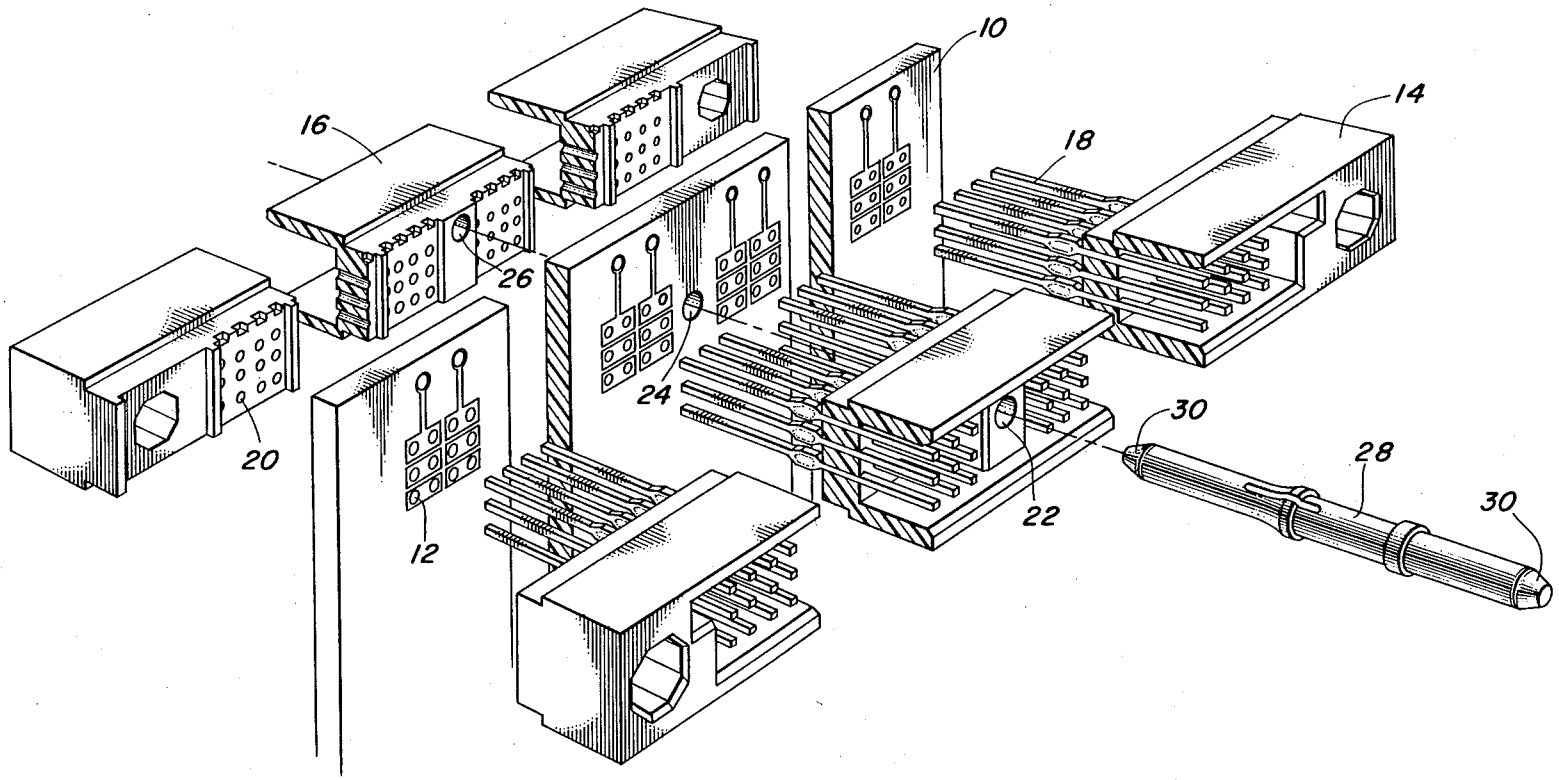
FIG. 1 is a pictorial view exploded form of a guide pin constructed in accordance with this invention, positioned for clamping and guiding header and shroud connectors on either side of a printed circuit board, using the guide pin to maintain proper alignment of the shroud and header.

There may be seen in FIG. 1 a typical application in which a printed circuit board 10 of conventional construction has a plurality of apertures 12 adapted to accommodate pins from connectors to couple the circuits on the board to external circuits. To accomplish this, it is necessary to mount a header connector 14 and a shroud connector 16 on opposite sides of the circuit board 10 with the header and shroud connectors in alignment. (Hereinafter header and shroud connectors are referred to simply as headers and shrouds). Plural rows and columns of pins 18 are mounted in the header 14 and adapted to pass through the correspondingly located apertures 12 in the printed circuit board thence through correspondingly located apertures 20 in the shroud 16 so that the pins 18 extending out of the back side of the shroud 16. The pins 18, now extending from the header 14 and the shroud 16, may accommodate connectors (not shown) which permit the mounting of daughter boards (not shown) to the board 10 which is typically referred to as a mother board.

In applications where the connectors are lengthened to accommodate greater and greater numbers of pins 18, is it necessary to form an aperture 22 in the header in alignment with an aperture 24 in the circuit board 10 and with an aperture 26 formed in the shroud 16 so that all three can accommodate a guide pin. As noted hereinbefore, the guide pin, which assists in maintaining alignment between the pins 18 and the apertures 12 and 20 and the daughter board connector sockets (not shown), engages the circuit board 10 and shroud 16. In each case the pins 18 help to align the connectors and to overcome minor warping of the connectors and the like. In the prior art, these guides pins as noted above were constructed of metallic materials which have the disadvantages noted.

Figure 2:
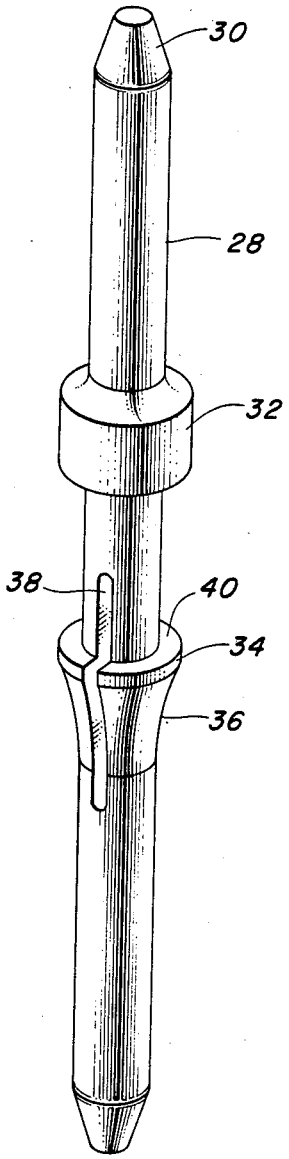
FIG. 2 is a pictorial representation of a guide pin constructed in accordance with this invention.
Figure 3:
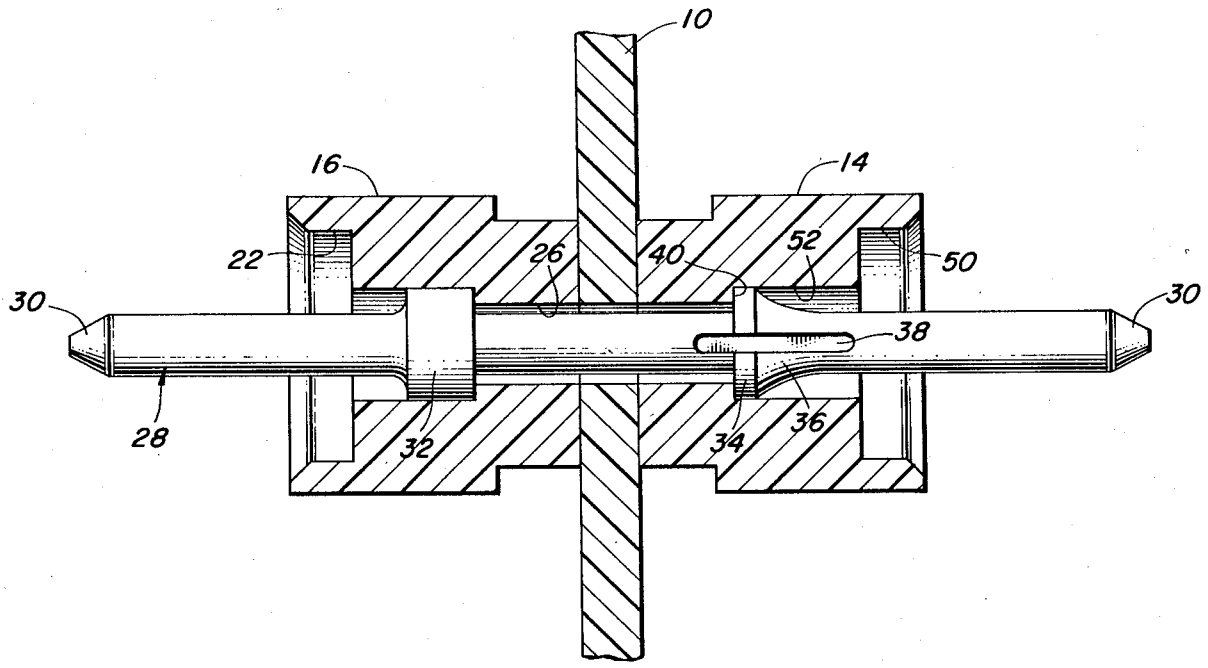
FIG. 3 is a cross-sectional elevation view of the pin in use.

In accordance with this invention a guide pin 28 is constructed, as shown in FIG. 2, to be elongated with its ends 30 each tapered to facilitate their insertion into the appropriate connector and circuit board elements. A first flange 32 is formed between the mid-portion thereof and the upper tapered end 30 (in the drawing). A second flange 34 is located between the mid portion of the pin and the other tapered end 30 (the left hand side of the drawing). The second flange 34 is tapered as at 36 toward the lower tapered end 30. Finally, a longitudinal slot 38 is formed along the longitudinal axis of the guide pin 28 in the vicinity of the second flange to completely encompass the longitudinal or axial length of the second flange. This slot, which may typically have a width of $\frac{1}{8}$ to $\frac{1}{4}$ of the internal diameter of the guide pin 28, and may extend through the guide pin, or alternatively may extend part way through the guide pin leaving a longitudinal interior web. Either design facilitates the collapse of the second flange. This permits the guide pin 28 to be introduced through the circuit board and connector apertures as will be described. In short, the guide pin because of the slot 38, is compliant and collapsible in the region of the second flange 34.

The guide pin 28 preferably is made of a suitable engineering plastic that permits a high degree of elongation, i.e., over 5% without brittle fracture so that it can accommodate and properly clamp the circuit board between the header and shroud. Preferably it may be made of a polyetherimide, a polyester, or nylon. It may be injection molded or transfer molded as desired. Either of these molding processes are relatively low cost and easily accomplished.

In use, the guide pin may be introduced into the aperture 22 of the header 14 and into a corresponding aperture 26 of the shroud 16. In any event it is introduced with the slotted portion first so that the taper 36 in conjunction with the slot 38 facilitates the compliant second flange 34 to be reduced in diameter. This permits the tapered portion 36 of the pin 28 and the second flange 34 to be squeezed through the apertures 22, 24 and 26 until the back surface 40 passes through the shroud aperture. Further movement of the pin is stopped by the first flange 32. The back surface 40 of the second flange engages the shroud 16 such that the header 14 board 10 and shroud 16 are locked between the first and second flanges 32 and 34. To facilitate this locking feature the header 14 is bored as at 50 and counter bored as at 52 so that the counter bore 52 engages the flange back surface 40. Similarly, the shroud 16 bore 22 is counter bored as at 54 to engage the backside of the flange 32.

With this accomplished, suitable keys (not shown) are used to lock the header to the shroud and the circuit board 10 is now in condition to recieve daughter boards plugged into the respective headers and shrouds.

The guide pin thus described is seen to be relatively easy and inexpensive to manufacture and to use. Being of a compliant plastic it does not provide any electrical shorting problems of inductive problems and may relatively easily snapped in place in the apertures 22, 24 and 26. It is usable from one side of the circuit board. This greatly facilitates its use and assembly in close spaces since in many cases access may be had to only one side of the board. With the guide pin in position minor warping or bending of the connectors is correctd to obtain proper alignment of the apertures of the several connectors and circuit board. The flanges of the pin aid in clamping the circuit board between the connectors. The pin is easily manufactured by suitable injection molding or transfer molding processes which are well known.

What is claimed is:

1. A double ended guide pin adapted to secure and position header and shroud connectors on opposite sides of a printed circuit board, the guide pin being positionable in one connector and adapted to engage apertures similarly located in the other connector and the circuit board, the guide pin comprising:

an integral elongated pin having a longitudinal axis, tapered ends, a first flange located thereon between the mid-portion of the pin and on end, and a second flange located thereon between the mid-portion of the pin and the other end, the second flange being tapered in on one side toward the other end of the pin, the pin including a slot extending along the longitudinal axis in the region of the second flange, the entire length of the slot being located between said tapered ends of the pin thereby to facilitate insertion of the second flange through the apertures in the connectors and circuit board.

2. The double ended guide pin of claim 1 wherein the guide pin has a generally circular cross-section taken along the longitudinal axis and is formed of a plastic.

3. The double ended pin of claim 2 wherein the flanges are separated along the pin axis by a distance corresponding to the axial length of the connector apertures and the thickness of the circuit board, thereby to attach the circuit board between the connectors.

4. The double ended guide pin of claim 2 wherein the plastic is selected from the group consisting of polyeetherimide, polyester, and nylon.

5. The double ended guide pin of claim 1 where the flanges are separated along the pin axis by distance-corresponding to the axial length of one of the connector apertures and the thickness of the circuit board, thereby to attach the circuit board between the connectors.

6. The double ended guide pin of claim 2 wherein the pin is slotted partially through the diameter of the pin.

* * * * *